US010490395B2

(12) United States Patent
Yasuda

(10) Patent No.: US 10,490,395 B2
(45) Date of Patent: Nov. 26, 2019

(54) ICP ANALYZER

(71) Applicant: SHIMADZU CORPORATION, Kyoto-shi, Kyoto (JP)

(72) Inventor: Naoki Yasuda, Kyotanabe (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/163,858

(22) Filed: May 25, 2016

(65) Prior Publication Data

US 2016/0349333 A1 Dec. 1, 2016

(30) Foreign Application Priority Data

May 27, 2015 (JP) ..... 2015-107622

(51) Int. Cl.
*H01J 49/10* (2006.01)
*H05H 1/00* (2006.01)
*H05H 1/30* (2006.01)

(52) U.S. Cl.
CPC ..... *H01J 49/105* (2013.01); *H05H 1/0037* (2013.01); *H05H 1/30* (2013.01)

(58) Field of Classification Search
CPC ..... G01R 31/40; H05H 1/30; H05H 1/0037; H01J 49/105
See application file for complete search history.

(56) References Cited

U.S. PATENT DOCUMENTS 5,334,834 A * 8/1994 Ito ..... H01J 49/105 250/288
5,383,019 A 1/1995 Farrell et al.
7,123,361 B1 * 10/2006 Doughty ..... G01J 3/02 356/316
7,459,899 B2 * 12/2008 Mattaboni ..... G01N 21/73 324/76.53

(Continued)

FOREIGN PATENT DOCUMENTS

JP 63-196841 A 8/1988
JP 5-212547 A 8/1993

(Continued)

OTHER PUBLICATIONS

Communication dated Oct. 30, 2018, from Japanese Patent Office in counterpart application No. 2015-107622.

(Continued)

*Primary Examiner* — Akm Zakaria
(74) *Attorney, Agent, or Firm* — Sughrue Mion, PLLC

(57) ABSTRACT

An ICP analyzer 100 includes a self-oscillation radio-frequency power supply unit 120 for supplying radio-frequency power for generating plasma to an induction coil 111 wound around a plasma torch 110. To check the type of plasma torch 110, the analyzer 100 further includes: a frequency measurement section 121 for measuring an output frequency of the power supply unit 120; a storage unit 190 holding a reference output frequency for each type of plasma torch; and a torch checker 132 for determining whether or not the output frequency measured by the frequency measurement (Continued)

section 121 after the plasma is lit agrees with any one of the reference output frequencies, and for giving notification of the determination result.

11 Claims, 5 Drawing Sheets

(56) References Cited

U.S. PATENT DOCUMENTS

2010/0300620 A1* 12/2010 Kanda ..... H01J 37/321 156/345.28
2011/0193483 A1* 8/2011 Mattaboni ..... G01N 21/73 315/111.21
2013/0200257 A1* 8/2013 Chapon ..... H01J 49/36 250/282
2014/0312011 A1* 10/2014 Hosoya ..... B23K 10/02 219/121.46
2014/0360996 A1* 12/2014 Murakami ..... B23K 9/0953 219/130.21
2015/0108898 A1* 4/2015 Cheung ..... H05H 1/30 315/111.51

FOREIGN PATENT DOCUMENTS

JP 2006066552 A 3/2006
JP 2007-205898 A 8/2007
JP 2007-205899 A 8/2007
WO 2012/039035 A1 3/2012

OTHER PUBLICATIONS

Communication dated May 8, 2018 issued by the Japanese Patent Office in counterpart application No. 2015-107622.

* cited by examiner

ICP ANALYZER

TECHNICAL FIELD

The present invention relates to an inductively coupled plasma (ICP) analyzer which uses an ICP light source for inducing a plasma emission or ionization of a liquid sample, such as an ICP emission spectrometer or ICP mass spectrometer.

BACKGROUND ART

An ICP emission spectrometer performs a quantitative or qualitative analysis of an element contained in a sample by determining the wavelength and strength of an atomic spectrum obtained by dispersing light which is emitted from the sample atom when this atom transitions to a lower energy level after being introduced into plasma and thereby excited.

As shown in FIG. 5, an ICP emission spectrometer includes: a plasma torch 310 for forming plasma, with an induction coil 311 wound around it; a sample introduction unit 340 for introducing a sample into the plasma torch 310; a gas flow control unit 350 for supplying plasma gas and cooling gas to the plasma torch 310 as well as carrier gas to the sample introduction unit 340, and for controlling their flow rates, a power supply unit 320 for supplying radio-frequency power to the induction coil 311; a control unit 330 for controlling each of these units; a spectroscope 371 for dispersing light from the plasma generated within the plasma torch 310; a detector 372 for detecting the dispersed light and for producing detection data representing the strength of the detected light; and a data processing unit 360 for processing the detection data (for example, see Patent Literature 1).

To perform an analysis of a sample using the ICP emission spectrometer 300, initially, while plasma gas and cooling gas are supplied at a predetermined flow rate from the gas flow control unit 350 to the plasma torch 310, a predetermined amount of radio-frequency power is supplied from the power supply unit 320 to the induction coil 311 in order to ignite radio-frequency induction plasma by a spark discharge. A stream of carrier gas is supplied from the gas flow control unit 350 to the sample introduction unit 340. The sample which is injected into and nebulized by this carrier gas is introduced into the plasma. Consequently, the excitation emission from the sample molecule occurs.

As the power supply unit, a self-oscillation radio-frequency power source as described in Patent Literature 2 has been proposed. In the ICP emission analyzer using this self-oscillation radio-frequency power source, an LC oscillation circuit is formed by a capacitor provided in the power source and the induction coil surrounding the plasma torch. The oscillation generated by this circuit produces a stable supply of radio-frequency power to the plasma torch.

The type of plasma torch is selected according to the kind or use of the sample to be analyzed. For example, a plasma torch for high-salt samples has a larger shape in its exit section than the standard plasma torch in order to prevent the adhesion of precipitated salts. A plasma torch for organic solvents has a smaller inner volume to allow for the vaporization of the sample within the plasma torch. Thus, different types of plasma torches have different shapes or inner volumes. Optimum values of the amount of radio-frequency power supply and the flow rate of the various kinds of gas also change depending on such differences. Accordingly, an operator should fit the ICP analyzer with the most suitable plasma torch for the analysis of the sample. The operator also sets, in the control unit, the type of plasma torch installed in the ICP analyzer. According to the setting, the control unit regulates the amount of power supply and the flow rate of the gas.

CITATION LIST

Patent Literature

Patent Literature 1: JP 2007-205899 A
Patent Literature 2: WO 2012/039035 A

SUMMARY OF INVENTION

Technical Problem

As just explained, the type of plasma torch installed in the ICP analyzer is manually set by the operator. If the operator incorrectly sets this information, the actually installed plasma torch will be supplied with incorrect amounts of radio-frequency power and gas which are intended for a different type of plasma torch. Consequently, the temperature of the plasma torch may excessively rise, causing the erosion of the torch or damage to the surrounding parts by its heat.

To prevent such an erosion and other problems, it would be preferable to provide a means for directly detecting the type of plasma torch. However, detecting the type of plasma torch through electrical devices (e.g. sensors and switches) is difficult to achieve since the radio-frequency current passing through the induction coil causes an electric noise in the space near the plasma torch.

The problem to be solved by the present invention is to provide an ICP analyzer including a self-oscillation radio-frequency power source, the ICP analyzer being capable of checking the type of the installed plasma torch.

Solution to Problem

The first aspect of the present invention developed for solving the previously described problem is an ICP analyzer including a self-oscillation power supply unit for supplying radio-frequency power for generating plasma to an induction coil wound around a plasma torch, the analyzer further including:

a) a frequency measurement section for measuring an output frequency of the power supply unit;

b) a storage section holding a reference output frequency for each type of plasma torch; and c) a torch checker for determining whether or not the output frequency measured by the frequency measurement section after the plasma is lit agrees with any one of the reference output frequencies held in the storage section, and for giving notification of the determination result.

In the ICP analyzer according to the present invention, the output frequency which results when an optimum radio-frequency power for the plasma torch is supplied is previously measured for each type of plasma torch that may be used. The measured values are stored as the reference output frequencies in the storage section.

In an analysis of a sample, the operator installs a plasma torch in the designated section in the ICP analyzer and sets the type of the installed plasma torch in a control unit. If the type of plasma torch which disagrees with that of the actually installed one is wrongly set in the control unit, or if an incorrect type of plasma torch is installed while the setting of the type of plasma torch in the control unit is correct, the frequency value measured by the frequency measurement section will be different from the reference frequency corresponding to the set type of plasma torch as well as from the reference frequency corresponding to any other type of plasma torch. The torch checker detects this situation and gives notification of it. This notification can take various forms, such as a message on a display device (e.g. monitor), a visual signal on a lamp, an audible alarm through a speaker, or a piece of data transmitted to a remote location.

The present invention can also be applied in an ICP analyzer for which the operator does not previously set the type of plasma torch in the control unit. In this case, the control unit controls the radio-frequency power supply unit so that the amount of power supplied to the plasma torch sequentially changes from lower to higher levels corresponding to a plurality of types of plasma torches that can be used. While one level of the radio-frequency power is being supplied, the torch checker compares the measured frequency with the reference output frequencies held in the storage section. If the measured value agrees with none of them, the torch determination section notifies the control unit of the result. Upon receiving this notification, the control unit increases the radio-frequency power to the next higher level. While such a process is repeated, when the radio-frequency power corresponding to the actually installed plasma torch is supplied, the measured frequency agrees with one of the reference frequencies. The control unit maintains the supplied radio-frequency power at this level and initiates the analysis.

The second aspect of the present invention developed for solving the previously described problem is an ICP analyzer including a self-oscillation power supply unit for supplying radio-frequency power for generating plasma to an induction coil wound around a plasma torch, the analyzer further including:

a) a frequency measurement section for measuring an output frequency of the power supply unit;

b) a storage section holding, for each type of plasma torch, a reference output frequency difference which is the difference between two output frequencies respectively measured before and after the plasma is lit; and c) a torch checker for determining whether or not the difference between the output frequencies respectively measured by the frequency measurement section before and after the plasma is lit agrees with any one of the reference output frequency differences held in the storage section, and for giving notification of the determination result.

The output frequency which is reached after the plasma is lit mainly depends on the type of plasma torch, the capacitance of a capacitor in the radio-frequency power source, the form of the induction coil, and various other factors. If the induction coil is deformed due to coming in contact with another member or due to aging, the output frequency may change according to the amount of deformation. If such a deformation occurs, it is no longer possible to correctly check the type of plasma torch if the reference output frequencies held in the storage section are unchanged from the values obtained before the deformation of the induction coil. On the other hand, the change in the output frequency due to the deformation of the induction coil similarly occurs before and after the plasma is lit. Accordingly, the difference between two output frequencies respectively measured before and after the plasma is lit barely changes even if the induction coil is deformed. Meanwhile, this difference in the output frequency changes depending on the type of plasma torch. Therefore, by determining the difference between the output frequencies measured before and after the plasma is lit for each type of plasma torch and saving it as the reference output frequency difference in the storage section, it is possible to correctly check the type of plasma torch by referring to this information, regardless of whether or not the induction coil is deformed.

Any of the previously described ICP analyzers should preferably further include a torch-lighting detector for detecting the lighting of the plasma in the plasma torch.

Since the plasma is lit after a certain period of time from the beginning of the power supply, it is possible to determine when the plasma is lit even without the torch-lighting detector, as in the first or second aspect of the present invention. In that case, in order to measure the output frequency at the timing when the plasma is assuredly lit, the frequency measurement section is normally configured so as to measure the output frequency after a predetermined period of time from the actual point of lighting of the plasma. This causes a corresponding delay in checking the type of plasma torch. By providing the torch-lighting detector, it is possible to check the type of plasma torch immediately after the plasma is lit.

The torch-lighting detector can be configured using either various kinds of sensors (e.g. photosensor or heat sensor) or measuring meters (e.g. wattmeter). In the case of using the photosensor, heat sensor or other types of sensors, the lighting of the plasma can be detected by placing the sensors at a distance from the induction coil and detecting through those sensors the light or heat which is generated when the plasma is lit. In the case of using the wattmeter, the lighting of the plasma can be detected by placing the wattmeter in the power supply unit and detecting an increase in the power due to the lighting of the plasma.

The ICP analyzer according to the present invention may additionally include a power supply stopper for discontinuing the supply of the radio-frequency power from the power supply unit to the induction coil wound around the plasma torch when notification is given of the determination that the measured output frequency is different from the reference output frequency corresponding to the type of plasma torch previously set in the control unit by the operator.

If it is determined by the torch checker that the measured output frequency is different from the reference output frequency corresponding to the type of plasma torch previously set by the operator, and if notification of this determination is given, the power supply stopper commands the power supply unit to discontinue its operation.

Advantageous Effects of the Invention

The ICP analyzer according to the present invention determines whether or not the output frequency measured after the plasma is lit agrees with the reference output frequency previously determined for each type of plasma torch, and gives notification of the determination result. Based on this notification, the operator can easily determine whether or not the type of plasma torch previously set in the control unit agrees with the type of the actually installed plasma torch.

DESCRIPTION OF EMBODIMENTS

Embodiments of the present invention are hereinafter described with reference to the drawings.

First Embodiment

Figure 1:
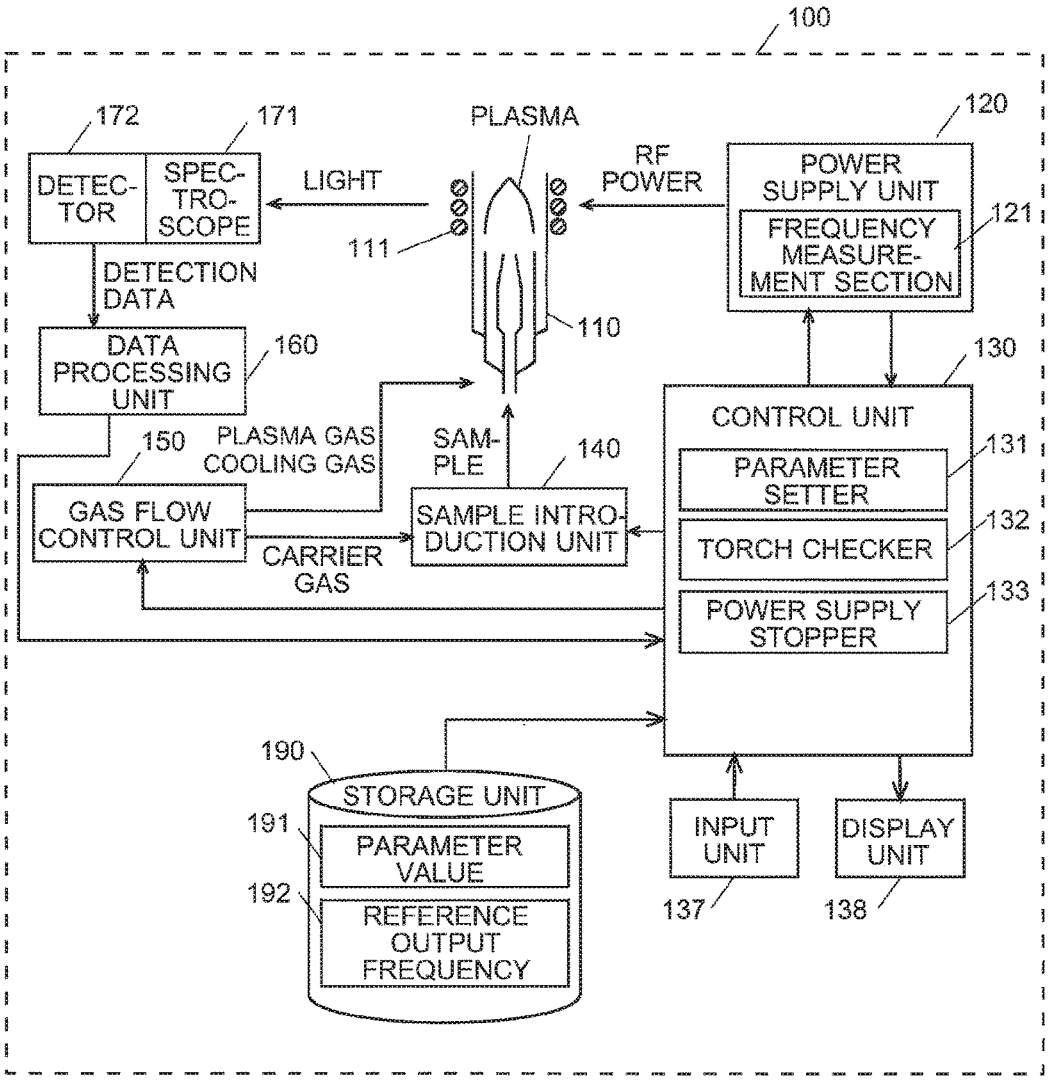
FIG. 1 is a schematic configuration diagram of an ICP emission spectrometer according to the first embodiment of the present invention.

FIG. 1 is a schematic configuration diagram of an ICP emission spectrometer 100 according to the first embodiment of the present invention. This ICP emission spectrometer 100 includes: a plasma torch 110 into which a stream of gas for forming plasma is introduced; a sample introduction unit 140 for introducing a sample into the plasma torch 110; a gas flow control unit 150 for supplying plasma gas and cooling gas to the plasma torch 110 as well as carrier gas to the sample introduction unit 140; a power supply unit 120 for supplying radio-frequency power to the induction coil 111 wound around the plasma torch 110; a control unit 130 for controlling each of these units; a spectroscope 171 for dispersing light from the plasma generated within the plasma torch 110; a detector 172 for detecting the dispersed light and for producing detection data representing the strength of the detected light; a data processing unit 160 for processing the detection data; and a storage unit 190 for holding parameters for each type of plasma torch.

The power supply unit 120 is a self-oscillation radio-frequency power source with the LC oscillation circuit formed by a capacitor in the power supply unit 120 and the induction coil 111. The power supply unit 120 passes a radio-frequency current through the induction coil 111 according to a command from the control unit 130. The output frequency of this radio-frequency current is measured by the frequency measurement section 121 (e.g. a frequency counter for radio-frequency current) in the power supply unit 120.

The control unit 130 is composed of a central processing unit (CPU) for performing various computations, a memory unit, a mass storage (e.g. hard disk drive) and other devices. The control unit 130 regulates the flow rate and the timing of introduction of various kinds of gas (plasma gas, cooling gas and carrier gas) supplied from the gas flow control unit 150 as well as operates the power supply unit 120 to control the amount of power supply. The parameter setter 131, torch checker 132 and power supply stopper 133 in the control unit 130 are realized by the CPU executing predetermined programs (although the torch checker 132 may be created as a hardware component using electric circuits). An input unit 137 for allowing an operator to perform various settings and a display unit 138 for displaying the settings, obtained sample data and various other items of information are connected to the control unit 130.

The storage unit 190 includes a memory unit and mass storage (e.g. hard disk). The control unit 130 saves data in them and reads data from them. The storage unit 190 holds various parameter values 191, which include: the type of plasma torch to be installed in the ICP emission spectrometer 100; the flow rate and the timing of introduction for various kinds of gas specified for each type of torch; and the amount of power supply to the induction coil 111. Additionally, the reference output frequency 192, i.e. the output frequency which should be observed when the parameter values 191 are correctly set according to the type of plasma torch, is also stored for each type of plasma torch.

The spectroscope 171 disperses the light emitted from the plasma and introduces the dispersed light into the detector 172. Upon detecting the introduced light, the detector 172 produces detection data corresponding to the strength of the light and sends the data to the data processing unit 160. In the data processing unit 160, the detection data are processed in various ways. The results of the process are sent to the control unit 130 and shown on the display unit 138.

Figure 2:
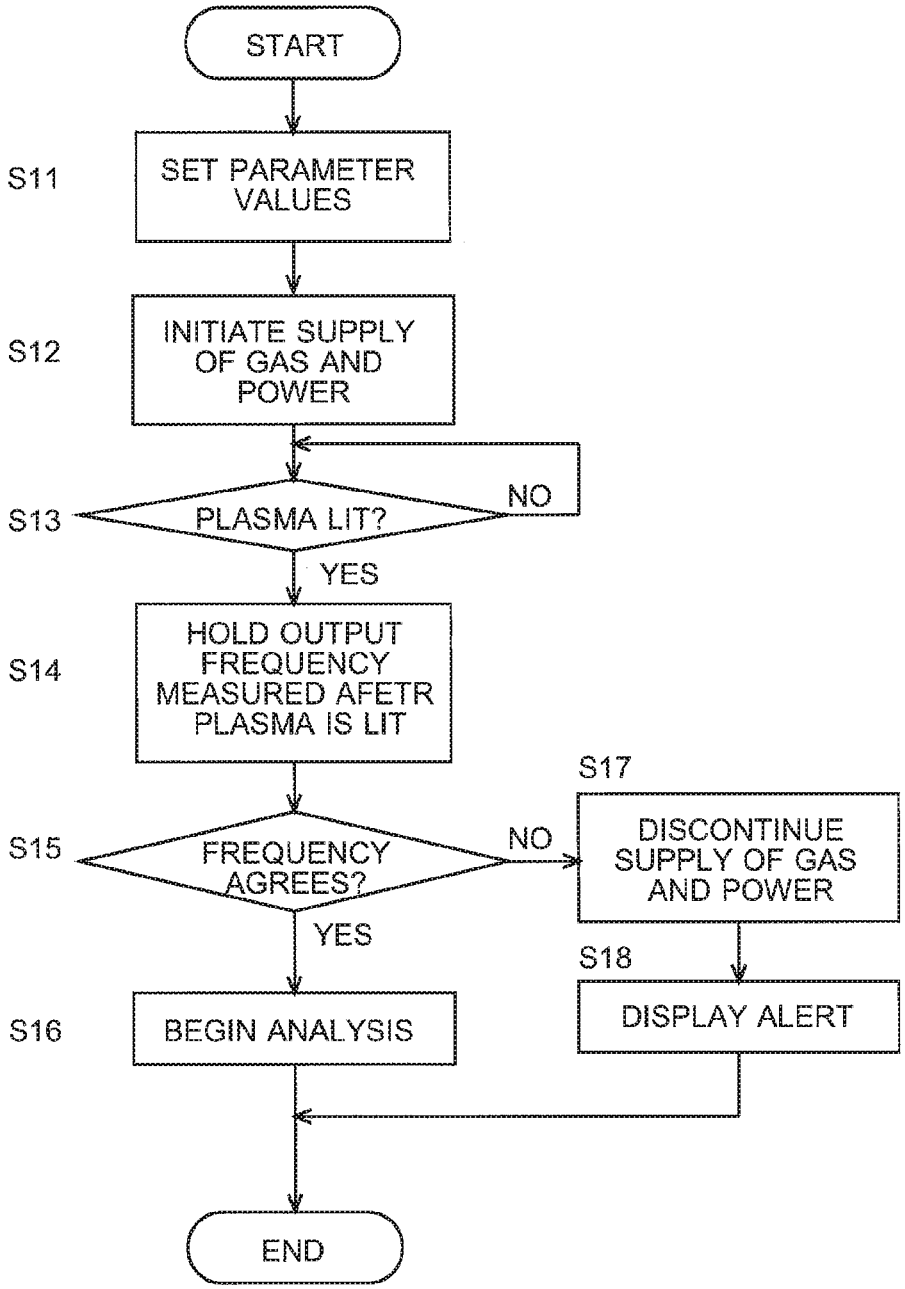
FIG. 2 is a flowchart showing the process of checking the type of plasma torch in the first embodiment.

An operation of the ICP emission spectrometer 100 according to the present embodiment is described with reference to FIGS. 1 and 2. FIG. 2 is a flowchart showing the process of checking the type of plasma torch installed in the ICP emission spectrometer 100. In the present embodiment, the operator fits the ICP emission spectrometer 100 with the most suitable type of plasma torch for the sample to be analyzed, and previously sets the type of that plasma torch from the input unit 137 connected to the control unit 130. After these tasks are completed, the operator performs a predetermined operation to initiate the plasma-lighting process. Then, the parameter setter 131 accesses the storage unit 190, retrieves the parameter values 191 corresponding to the type of plasma torch previously set in the control unit 130 by the operator, and sends these values to the gas flow control unit 150, sample introduction unit 140 and power supply unit 120 to configure these units (Step S11). Subsequently, the control unit 130 sends a command for initiating the supply of the gas and power. Upon receiving this command, the gas flow control unit 150 begins to supply the various kinds of gas to the plasma torch 110, while the power supply unit 120 begins to supply radio-frequency power to the induction coil 111 (Step S12).

After the power supply is initiated, the power supply unit 120 continuously measures the output frequency through the frequency measurement section 121 and sends the measured result to the control unit 130 as the measured output frequency. The control unit 130 measures the passage of time from the beginning of the power supply and stands by until the period of time necessary for the plasma to be lit is elapsed ("NO" in Step S13). When this period of time has passed ("YES" in Step S13), the control unit 130 determines that the plasma has been lit, and holds the measured output frequency in its internal memory (Step S14).

Next, the torch checker 132 in the control unit 130 compares the measured output frequency with the reference output frequency 192 corresponding to the type of plasma torch previously set by the operator. If the measured output frequency agrees with the reference output frequency 192 ("YES" in Step S15), the torch checker 132 concludes that the plasma torch 110 installed in the ICP emission spectrometer 100 is indeed the type of plasma torch which corresponds to the parameter values set in the control unit 130, and notifies the operator of this result through the display unit 138. Subsequently, the control unit 130 commands the sample introduction unit 140 to inject the sample, whereby the analysis of the sample is initiated (Step S16).

If the measured output frequency does not agree with the reference output frequency 192 ("NO" in Step S15), the torch checker 132 concludes that the installed plasma torch 110 does not agree with the type of plasma torch previously set in the control unit 130 by the operator. The power supply stopper 133 in the control unit 130 commands the power supply unit 120, gas flow control unit 150 and sample introduction unit 140 to discontinue the supply of the radio-frequency power and the various kinds of gas, whereby the supply of the power and gas is discontinued (Step S17). Simultaneously, the torch checker 132 displays an alert message on the display unit 138 to notify the operator of the fact that the setting of the plasma torch is incorrect (Step S18).

Second Embodiment

Figure 3:
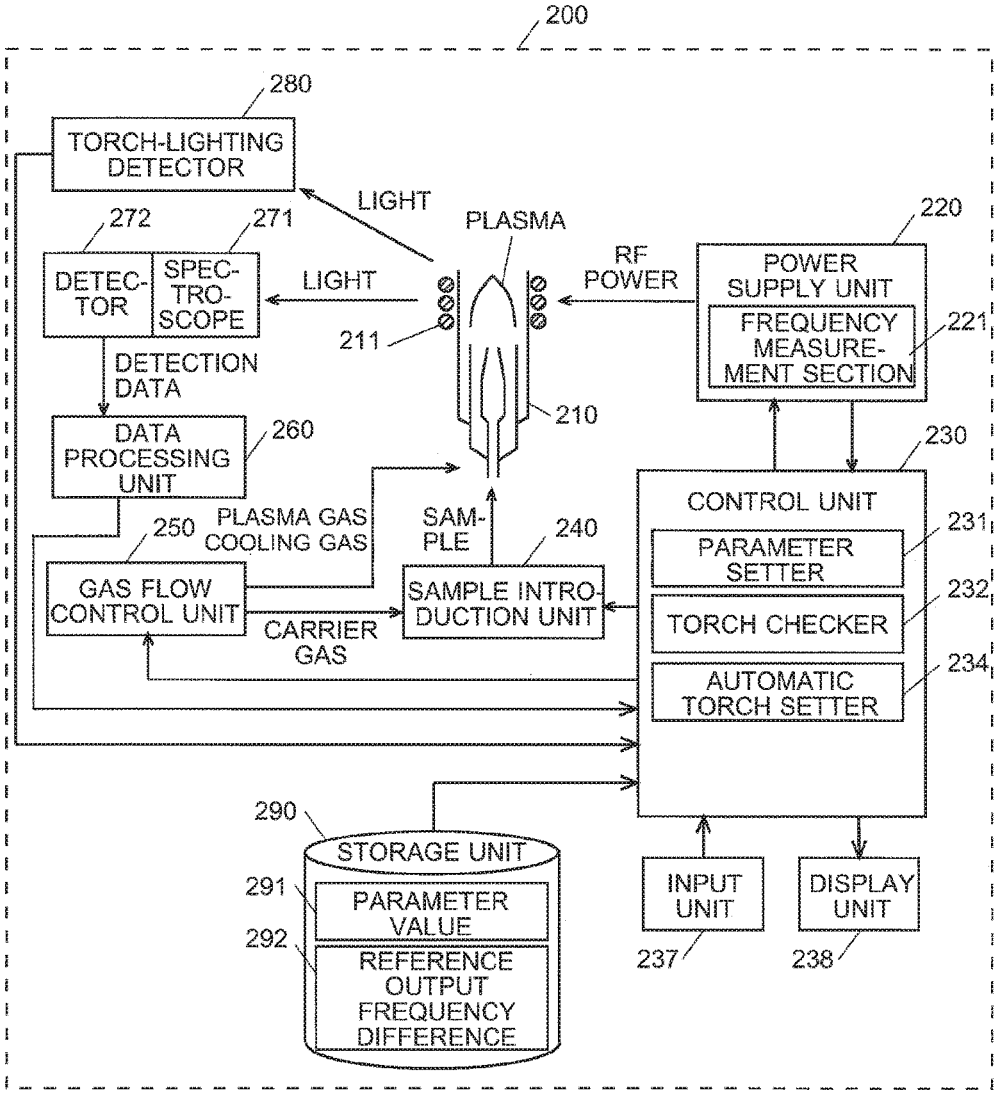
FIG. 3 is a schematic configuration diagram of an ICP emission spectrometer according to the second embodiment of the present invention.

Subsequently, an ICP emission spectrometer according to the second embodiment of the present invention is described. FIG. 3 is a schematic configuration diagram of the ICP emission spectrometer 200 according to the second embodiment of the present invention. In addition to the configuration of the first embodiment, the device in the present embodiment includes a torch-lighting detector 280 for detecting the light from the plasma torch 210 and an automatic torch setter 234 provided in the control unit 230. The storage unit 290 holds a reference output frequency difference 292 in place of the reference output frequency. The power supply stopper is not provided. The rest of the configuration is the same as shown in FIG. 1. Accordingly, the components which are identical or correspond to the already described counterparts are denoted by numerals which have the same last two digits as those given to the counterparts, and descriptions of those components will be appropriately omitted.

Figure 4:
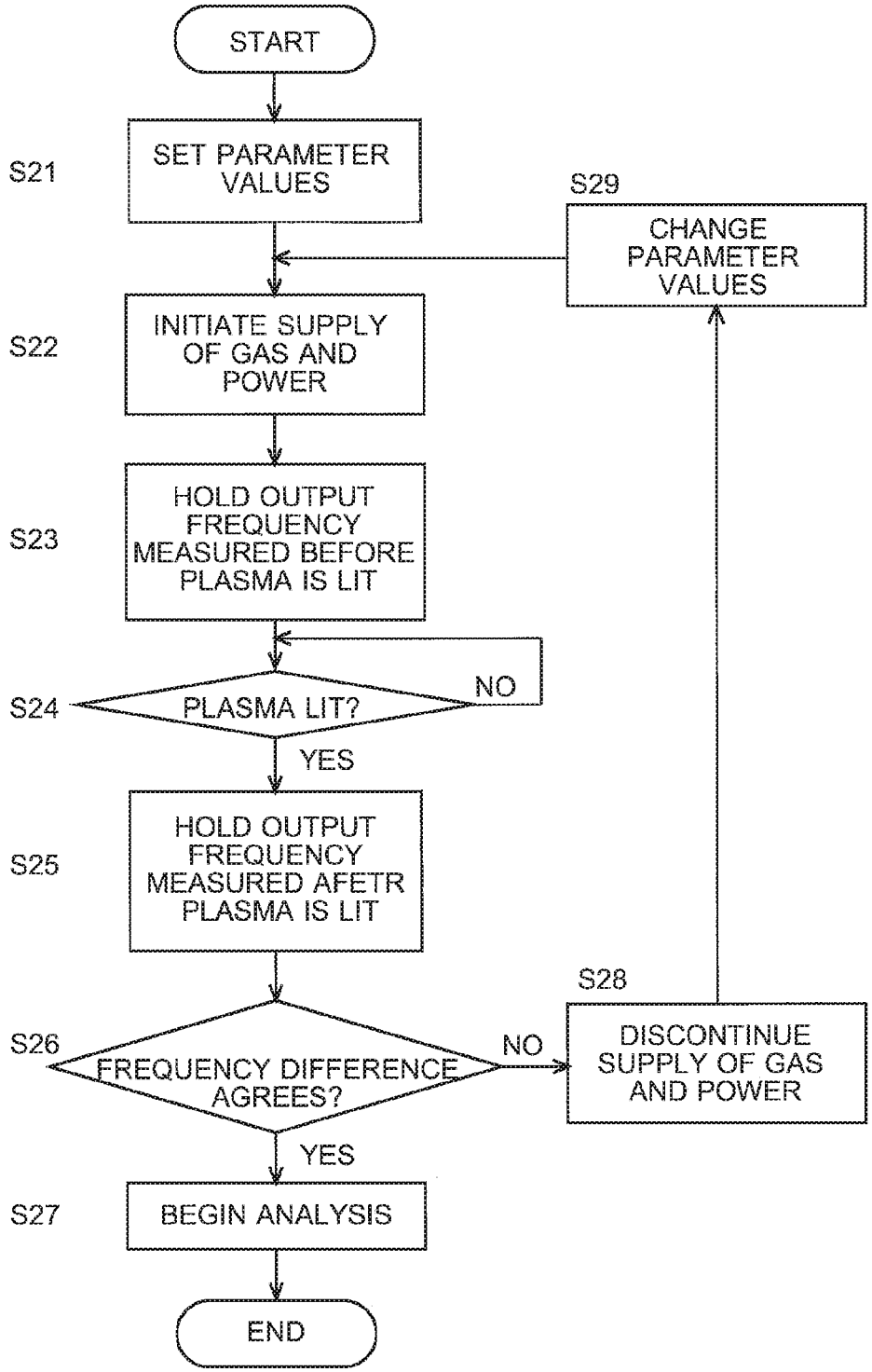
FIG. 4 is a flowchart showing the process of automatically setting parameter values in the second embodiment.
Figure 5:
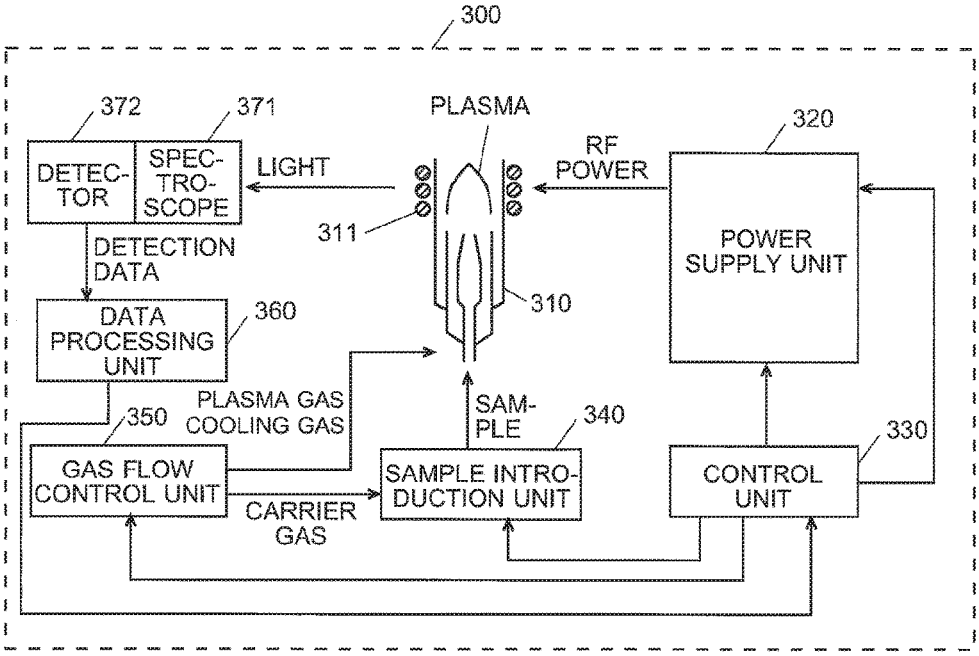
FIG. 5 is a schematic configuration diagram of a conventional ICP emission spectrometer.

An operation of the ICP emission spectrometer 200 is hereinafter described with reference to FIGS. 3 and 4. FIG. 4 is a flowchart showing the process of automatically setting the parameter values used in the analysis. The operator previously fits the ICP emission spectrometer 200 with the most suitable type of torch for the sample to be analyzed. Initially, the operator performs a predetermined operation to initiate the plasma-lighting process. The parameter setter 231 reads, from the parameter values 291 held in the storage unit 290, a set of parameter values including the lowest power supply value, and sends these values to the power supply unit 220, sample introduction unit 240 and gas flow control unit 250 to configure these units (Step S21). Next, the control unit 230 issues a command for initiating the supply of gas and power. Upon receiving this command, the gas flow control unit 250 begins to supply the various kinds of gas to the plasma torch 210, while the power supply unit 220 begins to supply radio-frequency power to the induction coil 211 (Step S22).

After the supply of the power is initiated, the frequency measurement section 221 measures the output frequency of the radio-frequency current supplied from the power supply unit 220 to the induction coil 211. The measured output frequency is continuously sent to the control unit 230. The control unit 230 receives the measured output frequencies in sequence and holds, in its memory, one measured output frequency obtained before the plasma is lit (Step S23).

The torch-lighting detector 280 includes a photosensor, such as a charge coupled device (CCD), for detecting light from the plasma. The detector sends the control unit 230 a signal indicative of the presence or absence of light.

The control unit 230 monitors the detection signals produced by the torch-lighting detector 280 and determines whether or not the plasma is lit. Until the plasma is lit, the control unit 230 continues waiting for the notification from the torch-lighting detector 280 ("NO" in Step S24). When the plasma is lit, the light emitted from the plasma causes an increase in the output from the torch-lighting detector 280. When the output has exceeded the preset threshold, the control unit 230 determines that the plasma has been lit ("YES" in Step 24).

After it is determined that the plasma is lit, the control unit 230 holds, in its memory, one measured output frequency obtained after the plasma is lit (Step S25).

Next, the torch checker 232 in the control unit 230 calculates the measured output frequency difference, i.e. the difference between the output frequency measured before the plasma was lit (the measurement result obtained in Step S23) and the output frequency measured after the plasma was lit (the measurement result obtained in Step S25). Subsequently, the torch checker 232 compares the measured output frequency difference with the reference output frequency differences 292 held in the storage unit 290, determines whether or not the measured output frequency difference agrees with any one of these reference output frequency differences, and shows the result on the display unit 238 to notify the operator of it.

In the previous determination process, if it is determined that the measured output frequency difference does not agree with any one of the reference output frequency differences 292 ("NO" in Step S26), the control unit 230 commands the power supply unit 220, gas flow control unit 250 and sample introduction unit 240 to discontinue the supply of the radio-frequency power and the various kinds of gas, whereby the supply of the power and gas is discontinued (Step S28).

Subsequently, the automatic torch setter 234 reads another set of parameter values 291 from the storage unit 290 and sets these values in the gas flow control unit 250, sample introduction unit 240 and power supply unit 220 (Step S29). The set of parameter values 291 which are read in this step is the set which includes the second lowest power supply value to the currently set power supply value. In the subsequent process, when the set of parameter values 291 is changed, the reading of the parameter set should be performed in ascending order of the power supply value.

After the parameter values 291 are changed, the processes of Steps S22, S23 and S24 are once more performed. After the plasma is lit ("YES" in Step S24), if it is determined that the measured output frequency difference calculated in Step S25 agrees with one of the reference output frequency differences 292 ("YES" in Step S26), the control unit 230 commands the sample introduction unit 240 to inject the sample, whereby the analysis of the sample is initiated (Step S27).

Thus, according to the present embodiment, the type of plasma torch installed in the ICP emission spectrometer 200 can be checked by determining whether or not the measured output frequency difference agrees with any of the reference output frequency differences 292. The control unit 230 can automatically change the parameter values and perform the analysis using the suitable parameter settings for the type of the installed plasma torch.

The previously described embodiments of the ICP emission spectrometer according to the present invention can be appropriately changed or modified within the spirit of the present invention. For example, it is possible to use the spectroscope and the detector to determine whether or not the plasma is lit, instead of providing the photosensor as the torch-lighting detector as in the second embodiment. According to this configuration, it is unnecessary to provide the additional photosensor.

In the first embodiment, the torch-lighting detector may additionally be provided. Conversely, in the second embodiment, the torch-lighting detector may be omitted and whether or not the plasma is lit may be determined based on the passage of time.

In the first embodiment, the configuration for checking the type of plasma torch based on the output frequency measured after the plasma is lit may additionally be provided with the automatic torch setter so as to automatically perform the setting for the torch. In the second embodiment, the configuration for checking the type of plasma torch based on the difference in the output frequencies measured before and after the plasma is lit may additionally be provided with the power supply stopper so as to automatically discontinue the power supply by the power supply unit when it is determined that the type of the installed plasma torch disagrees with the type of plasma torch previously set by the operator.

REFERENCE SIGNS LIST

100, 200 . . . ICP Emission Spectrometer
110, 210 . . . Plasma Torch
111, 211 . . . Induction Coil
120, 220 . . . Power Supply Unit
121, 221 . . . Frequency Measurement Section
130, 230 . . . Control Unit
131, 231 . . . Parameter Setter
132, 232 . . . Torch Checker
133 . . . Power Supply Stopper
234 . . . Automatic Torch Setter
137, 237 . . . Input Unit
138, 238 . . . Display Unit
140, 240 . . . Sample Introduction Unit
150, 250 . . . Gas Flow Control Unit
160, 260 . . . Data Processing Unit
171, 271 . . . Spectroscope
172, 272 . . . Detector
280 . . . Torch-Lighting Detector
190, 290 . . . Storage Unit
191, 291 . . . Parameter Values
192 . . . Reference Output Frequency
292 . . . Reference Output Frequency Difference

The invention claimed is:

1. An inductively coupled plasma analyzer including a self-oscillation power supply unit for supplying radio-frequency power for generating plasma to an induction coil wound around a plasma torch, the analyzer comprising:

a frequency counter for measuring an output frequency of the power supply unit;

a memory holding a set of plural reference output frequencies corresponding to each type of plasma torch from a set of plural types of plasma torches, each of the reference output frequencies being a frequency of the radio-frequency power supplied from the power supply unit when an appropriate radio-frequency power is supplied to a corresponding type of plasma torch;

an input unit for inputting a type of the plasma torch installed in the inductively coupled plasma analyzer; and a control unit configured to determine whether or not the output frequency measured by the frequency counter after the plasma is lit agrees with the reference output frequency corresponding to the type of plasma torch input through the input unit held in the memory, for giving notification of a determination result; and for modifying operation of the plasma torch or induction coil based on a determination whether or not the output frequency measured by the frequency counter after the plasma is lit agrees with the reference output frequency corresponding to the type of plasma torch input through the input unit held in the memory.

2. The inductively coupled plasma analyzer according to claim 1, further comprising:

an automatic torch setter for automatically switching the reference output frequency to a value corresponding to a different type of plasma torch when it is determined that the type of plasma torch corresponding to the reference output frequency used in the determination is different from the type of plasma torch installed in the inductively coupled plasma analyzer.

3. The inductively coupled plasma analyzer according to claim 1, further comprising:

a controller for automatically changing a parameter setting to an optimum value for the plasma torch installed in the inductively coupled plasma analyzer when it is determined that the type of plasma torch corresponding to the reference output frequency used in the determination is different from the type of the installed plasma torch.

4. The inductively coupled plasma analyzer according to claim 1, further comprising:

a power supply stopper for discontinuing a supply of the radio-frequency power from the power supply unit to the induction coil wound around the plasma torch when notification is given of a determination that the measured output frequency is different from the reference output frequency corresponding to the type of plasma torch previously set in a control unit by an operator.

5. An inductively coupled plasma analyzer including a self-oscillation power supply unit for supplying radio-frequency power for generating plasma to an induction coil wound around a plasma torch, the analyzer comprising:

a frequency counter for measuring an output frequency of the power supply unit;

a memory holding, for each type of plasma torch from a set of plural types of plasma torches, a reference output frequency difference which is the difference between two output frequencies respectively measured before and after the plasma is lit the reference output frequency difference being a difference between two output frequencies of the radio-frequency power supplied from the power supply unit respectively measured before and after the plasma is lit when an appropriate radio-frequency power is supplied to the corresponding type of plasma torch;

an input unit for inputting a type of the plasma torch installed in the inductively coupled plasma analyzer; and a control unit configured to determine whether or not a difference between the output frequencies respectively measured by the frequency counter before and after the plasma is lit agrees with the reference output frequency difference corresponding to the type of plasma torch input through the input unit held in the memory, for giving notification of a determination result; and for modifying operation of the plasma torch or induction coil based on a determination whether or not the difference between the output frequencies respectively measured by the frequency counter before and after the plasma is lit agrees with the reference output frequency corresponding to the type of plasma torch input through the input unit held in the memory.

6. The inductively coupled plasma analyzer according to claim 5, further comprising:

an automatic torch setter for automatically switching the reference output frequency difference to a value corresponding to a different type of plasma torch when it is determined that the type of plasma torch corresponding to the reference output frequency difference used in the determination is different from the type of plasma torch installed in the inductively coupled plasma analyzer.

7. The inductively coupled plasma analyzer according to claim 5, further comprising:

a controller for automatically changing a parameter setting to an optimum value for the plasma torch installed in the inductively coupled plasma analyzer when it is determined that the type of plasma torch corresponding to the reference output frequency difference used in the determination is different from the type of the installed plasma torch.

8. The inductively coupled plasma analyzer according to claim 5, further comprising:

a power supply stopper for discontinuing a supply of the radio-frequency power from the power supply unit to the induction coil wound around the plasma torch when notification is given of a determination that the difference between the output frequencies respectively measured before and after the plasma is lit is different from the reference output frequency difference corresponding to the type of plasma torch previously set in a control unit by an operator.

9. The inductively coupled plasma analyzer according to claim 1, further comprising:

a torch-lighting detector for detecting a lighting of the plasma in the plasma torch.

10. The inductively coupled plasma analyzer according to claim 5, further comprising:

a torch-lighting detector for detecting a lighting of the plasma in the plasma torch.

11. A plasma-torch checking method for an inductively coupled plasma analyzer including a plasma torch and a self-oscillation power supply unit for supplying radio-frequency power for generating plasma to an induction coil wound around the plasma torch, the method including steps of:

measuring an output frequency of the self-oscillation power supply unit by a frequency counter; and inputting, using an input unit, a type of the plasma torch installed in the inductively coupled plasma analyzer;

determining by a control unit whether or not the measured output frequency agrees with a reference output frequency corresponding to the type of the plasma torch through the input unit held in a memory, giving notification of a determination result, the reference output frequency being a frequency of the radio-frequency power supplied from the power supply unit when an appropriate radio-frequency power is supplied to the corresponding type of the plasma torch; and modifying operation of the plasma torch or induction coil based on a determination whether or not the output frequency measured by the frequency counter after the plasma is lit agrees with the reference output frequency corresponding to the type of the plasma torch through the input unit held in the memory.

* * * * *